US010539363B2

(12) United States Patent
Jager et al.

(10) Patent No.: US 10,539,363 B2
(45) Date of Patent: Jan. 21, 2020

(54) METHOD AND APPARATUS FOR COOLING A HYDROCARBON STREAM

(75) Inventors: Marco Dick Jager, The Hague (NL); Wouter Jan Meiring, Kuala Lumpur (MY)

(73) Assignee: SHELL OIL COMPANY, Houston, TX (US)

( * ) Notice: Subject to any disclaimer, the term of this patent is extended or adjusted under 35 U.S.C. 154(b) by 1412 days.

(21) Appl. No.: 12/866,049

(22) PCT Filed: Feb. 12, 2009

(86) PCT No.: PCT/EP2009/051621
§ 371 (c)(1),
(2), (4) Date: Oct. 18, 2010

(87) PCT Pub. No.: WO2009/101127
PCT Pub. Date: Aug. 20, 2009

(65) Prior Publication Data
US 2011/0023536 A1 Feb. 3, 2011

(51) Int. Cl.
*F25J 1/02* (2006.01)
*F25J 3/02* (2006.01)
*F25J 1/00* (2006.01)

(52) U.S. Cl.
CPC ..... *F25J 1/004* (2013.01); *F25J 1/0022* (2013.01); *F25J 1/0208* (2013.01); *F25J 1/0219* (2013.01);
(Continued)

(58) Field of Classification Search
CPC ..... F25J 3/0605; F25J 3/061; F25J 3/0615; F25J 3/0635; F25J 3/064; F25J 3/0645;
(Continued)

(56) References Cited

U.S. PATENT DOCUMENTS 2,930,202 A 3/1960 Yendall
3,203,191 A 8/1965 French
(Continued)

FOREIGN PATENT DOCUMENTS

DE 19821242 11/1999
EP 1008823 6/2000 ..... F25J 1/02
(Continued)

OTHER PUBLICATIONS

Paradowski H et al: "High Efficiency 6 MTPA LNG Train Design Via Two Different Mixed Refrigerant Processes" AICHE National Meeting, Mar. 10, 2002 (Mar. 10, 2002), pp. 245-257, XP009052299. p. 253, paragraph 3; figure 3.2.
(Continued)

*Primary Examiner* — John F Pettitt, III

(57) ABSTRACT

A method and apparatus for cooling a hydrocarbon stream such as natural gas. An initial hydrocarbon stream is passed through a first separator to provide an initial overhead stream and a mixed hydrocarbon feed stream. The initial overhead stream is cooled to provide a cooled hydrocarbon stream such as LNG, and at least a C1 overhead stream and one or more C2, C3 and C4 overhead streams are separated from the mixed hydrocarbon feed stream. At least a fraction of at least one of the group comprising: the C2 overhead stream, the C3 overhead stream and the C4 overhead stream is cooled with the C1 overhead stream to provide a cooled stream, which is further cooled against at least a fraction of the cooled, preferably liquefied, hydrocarbon stream to provide an at least partly liquefied cooled stream.

14 Claims, 3 Drawing Sheets

(52) U.S. Cl.
CPC ..... *F25J 1/0231* (2013.01); *F25J 3/0209* (2013.01); *F25J 3/0233* (2013.01); *F25J 3/0238* (2013.01); *F25J 3/0257* (2013.01); *F25J 3/0242* (2013.01); *F25J 3/0247* (2013.01)

(58) Field of Classification Search
CPC .... F25J 3/065; F25J 3/02; F25J 3/0204; F25J 3/0209; F25J 3/0214; F25J 3/0228; F25J 3/0233; F25J 3/0238; F25J 3/0242; F25J 3/0247; F25J 2205/02; F25J 2205/04; F25J 1/0231; F25J 1/004; F25J 1/0208; F25J 1/0219; F25J 1/022; F25J 3/0257
USPC ..... 62/618, 619, 620, 630, 611, 612, 613
See application file for complete search history.

(56) References Cited

U.S. PATENT DOCUMENTS

| | | | | |
|---|---|---|---|---|
| 3,274,787 | A | 9/1966 | Grenier et al. | 62/23 |
| 3,535,885 | A | 10/1970 | Frijlink et al. | |
| 3,616,652 | A | 11/1971 | Engel | |
| 3,702,063 | A | 11/1972 | Etzbach et al. | |
| 3,792,590 | A | 2/1974 | Lofredo et al. | |
| 4,033,735 | A | 7/1977 | Swenson | 62/9 |
| 4,155,729 | A | 5/1979 | Bellinger et al. | |
| 4,407,135 | A | 10/1983 | Pahade | |
| 4,541,852 | A | 9/1985 | Newton et al. | |
| 4,548,629 | A | 10/1985 | Chiu | |
| 5,535,594 | A | 7/1996 | Grenier | |
| 5,613,373 | A | 3/1997 | Grenier | |
| 5,659,109 | A | 8/1997 | Fernandez de la Vega et al. | |
| 5,669,234 | A | 9/1997 | Houser et al. | |
| 5,701,761 | A | 12/1997 | Prevost et al. | |
| 5,890,378 | A | 4/1999 | Rambo et al. | |
| 5,943,881 | A | 8/1999 | Grenier | |
| 6,041,620 | A | 3/2000 | Olszewski et al. | |
| 6,105,391 | A | 8/2000 | Capron | 62/613 |
| 6,116,050 | A | 9/2000 | Yao et al. | |
| 6,237,365 | B1 | 5/2001 | Trebble | |
| 6,333,445 | B1 | 12/2001 | O'Brien | |
| 6,378,330 | B1 | 4/2002 | Minta et al. | |
| 6,401,486 | B1 | 6/2002 | Lee et al. | |
| 6,591,632 | B1 | 7/2003 | Mahoney | |
| 6,658,892 | B2 | 12/2003 | Fanning et al. | |
| 6,662,589 | B1 | 12/2003 | Roberts et al. | |
| 7,051,553 | B2 | 5/2006 | Mak et al. | |
| 2002/0042550 | A1 | 4/2002 | Pironti et al. | |
| 2003/0177785 | A1 | 9/2003 | Kimble et al. | |
| 2004/0079107 | A1 | 4/2004 | Wilkinson et al. | |
| 2004/0177646 | A1 | 9/2004 | Wilkinson et al. | |
| 2005/0056051 | A1* | 3/2005 | Roberts | F25J 1/0022 62/612 |
| 2005/0155381 | A1 | 7/2005 | Yang et al. | |
| 2005/0247078 | A1 | 11/2005 | Wilkinson et al. | |
| 2005/0279133 | A1* | 12/2005 | Eaton | F25J 1/0022 62/613 |
| 2007/0012071 | A1 | 1/2007 | Huang et al. | 62/612 |
| 2007/0012072 | A1 | 1/2007 | Qualls et al. | |
| 2007/0056318 | A1* | 3/2007 | Ransbarger | 62/611 |
| 2007/0193303 | A1 | 8/2007 | Hawrysz et al. | |
| 2008/0016910 | A1 | 1/2008 | Brostow et al. | 62/630 |

FOREIGN PATENT DOCUMENTS

| | | | |
|---|---|---|---|
| EP | 1469266 | 10/2004 | F25J 1/02 |
| JP | H10053779 | 2/1998 | |
| JP | 2005042093 | 2/2005 | |
| JP | 2007536404 | 12/2007 | |
| WO | 0002101307 | 12/2002 | |
| WO | 0003106906 | 12/2003 | |
| WO | 20040109180 | 12/2004 | |
| WO | 20050045338 | 5/2005 | |
| WO | 20090101127 | 8/2009 | |

OTHER PUBLICATIONS

Schoenmakers, P.J. et al., "Comparision of Comprehensive Two-Dimensional Gas Chromatography and Gas Chromatography . . . ", Journal of Chromatography A, 892 (2000), pp. 29-46.

* cited by examiner

METHOD AND APPARATUS FOR COOLING A HYDROCARBON STREAM

PRIORITY CLAIM

The present application claims priority to PCT Application EP2009/051621, filed 12 Feb. 2009, which claims priority to European Patent Application No. EP 08101627.1, filed 14 Feb. 2008, which are incorporated herein by reference.

TECHNICAL FIELD OF THE INVENTION

The present invention relates to a method and apparatus for cooling a hydrocarbon stream, and to a liquefied natural gas plant or facility including such apparatus.

BACKGROUND OF THE INVENTION

A common hydrocarbon stream to be cooled, optionally to full liquefaction, is natural gas.

Natural gas is a useful fuel source, as well as being a source of various hydrocarbon compounds. It is often desirable to liquefy natural gas in a liquefied natural gas (LNG) plant at or near the source of a natural gas stream for a number of reasons. For example, natural gas can be stored and transported over long distances more readily as a liquid than in gaseous form, because it occupies a smaller volume and does not need to be stored at high pressure.

Usually, natural gas, comprising predominantly methane, enters an LNG plant at elevated pressures and is pre-treated to produce a purified feed stream suitable for liquefaction at cryogenic temperatures. The purified gas is processed through a plurality of cooling stages using heat exchangers to progressively reduce its temperature until liquefaction is achieved. The liquid natural gas is then further cooled and expanded to final atmospheric pressure suitable for storage and transportation.

In addition to methane, natural gas usually includes some heavier hydrocarbons and non-hydrocarbons, including but not limited to carbon dioxide, mercury, sulphur, hydrogen sulphide and other sulphur compounds, nitrogen, helium, water and other non-hydrocarbon acid gases, ethane, propane, butanes, $C_5$+ hydrocarbons and aromatic hydrocarbons. These and any other common or known heavier hydrocarbons and non-hydrocarbons either prevent or hinder the usual known methods of liquefying the methane, especially the most efficient methods of liquefying methane. Most if not all known or proposed methods of liquefying hydrocarbons, especially liquefying natural gas, are based on reducing as far as possible the levels of the non-hydrocarbons prior to the liquefying process, and reducing the levels of the heavier hydrocarbons at least for the main methane-based stream being liquefied.

Hydrocarbons heavier than methane and usually ethane are typically condensed and recovered as natural gas liquids (NGL) from a natural gas stream. The NGLs are usually fractionated in an NGL recovery system to yield valuable hydrocarbon products, either as products steams per se, or for use in liquefaction, for example as a component of a refrigerant or for reintroduction downstream with the main methane-based liquefied product stream.

However, NGL recovery conventionally involves cooling, condensation and fractionation steps that require significant amounts of refrigeration and other power consumption.

It is desirable to recover NGLs from a natural gas stream with the most efficient or minimal power consumption.

EP 1 469 266 A1 describes a process for the recovery of components heavier than methane from natural gas, including withdrawing from an absorber column a bottom stream enriched in components heavier than methane, and separating this into a stream containing methane and ethane, and one or more streams enriched in components heavier than ethane. However, a problem with EP 1 469 266 A1 is that its methane and ethane stream is liquefied in its main heat exchanger. This requires an extra bundle of cooling pipes in the main heat exchanger to accommodate the extra stream, and takes away cooling duty of the main heat exchanger from the main methane stream being liquefied.

SUMMARY OF THE INVENTION

The present invention provides a method of cooling a hydrocarbon stream comprising at least the steps of:

(a) passing an initial hydrocarbon stream through a first separator to provide an initial overhead stream and a mixed hydrocarbon feed stream;

(b) cooling, preferably liquefying, the initial overhead stream to provide a cooled, preferably liquefied, hydrocarbon stream such as LNG;

(c) separating at least a C1 overhead stream at a first pressure and one or more C2, C3 and C4 overhead streams from the mixed hydrocarbon feed stream;

(d) cooling at least a fraction of at least one of the group comprising: the C2 overhead stream, the C3 overhead stream and the C4 overhead stream; by admixing with the C1 overhead stream, to provide a cooled stream; and (e) further cooling the cooled stream against at least a fraction of the cooled, preferably liquefied, hydrocarbon stream to provide an at least partly liquefied cooled stream at a second pressure which is substantially the same as the first pressure.

The present invention also provides an apparatus for cooling a hydrocarbon stream comprising at least:

a first separator through which an initial hydrocarbon stream passes to provide an initial overhead stream and a mixed hydrocarbon feed stream;

a cooling system to cool, preferably liquefy, the initial overhead stream to provide a cooled, preferably liquefied, hydrocarbon stream such as LNG;

an NGL recovery system to separate at least a C1 overhead stream and one or more C2, C3 and C4 overhead streams from the mixed hydrocarbon feed stream;

a combiner to cool at least a fraction of at least one of the group comprising: the C2 overhead stream, the C3 overhead stream and the C4 overhead stream; by admixing with the C1 overhead stream, to provide a cooled stream; and one or more heat exchangers for further cooling the cooled stream against at least a fraction of the cooled, preferably liquefied, hydrocarbon stream to provide an at least partly liquefied cooled stream;

wherein there are no expansion or compression devices between the C1 overhead stream and the at least partly liquefied cooled stream.

The present invention also provides a liquefied natural gas plant or facility including an apparatus as herein defined.

BRIEF DESCRIPTION OF THE DRAWINGS

Embodiments and examples of the present invention will now be described by way of example only and with reference to the accompanying non-limiting drawings in which.

Figure 1:
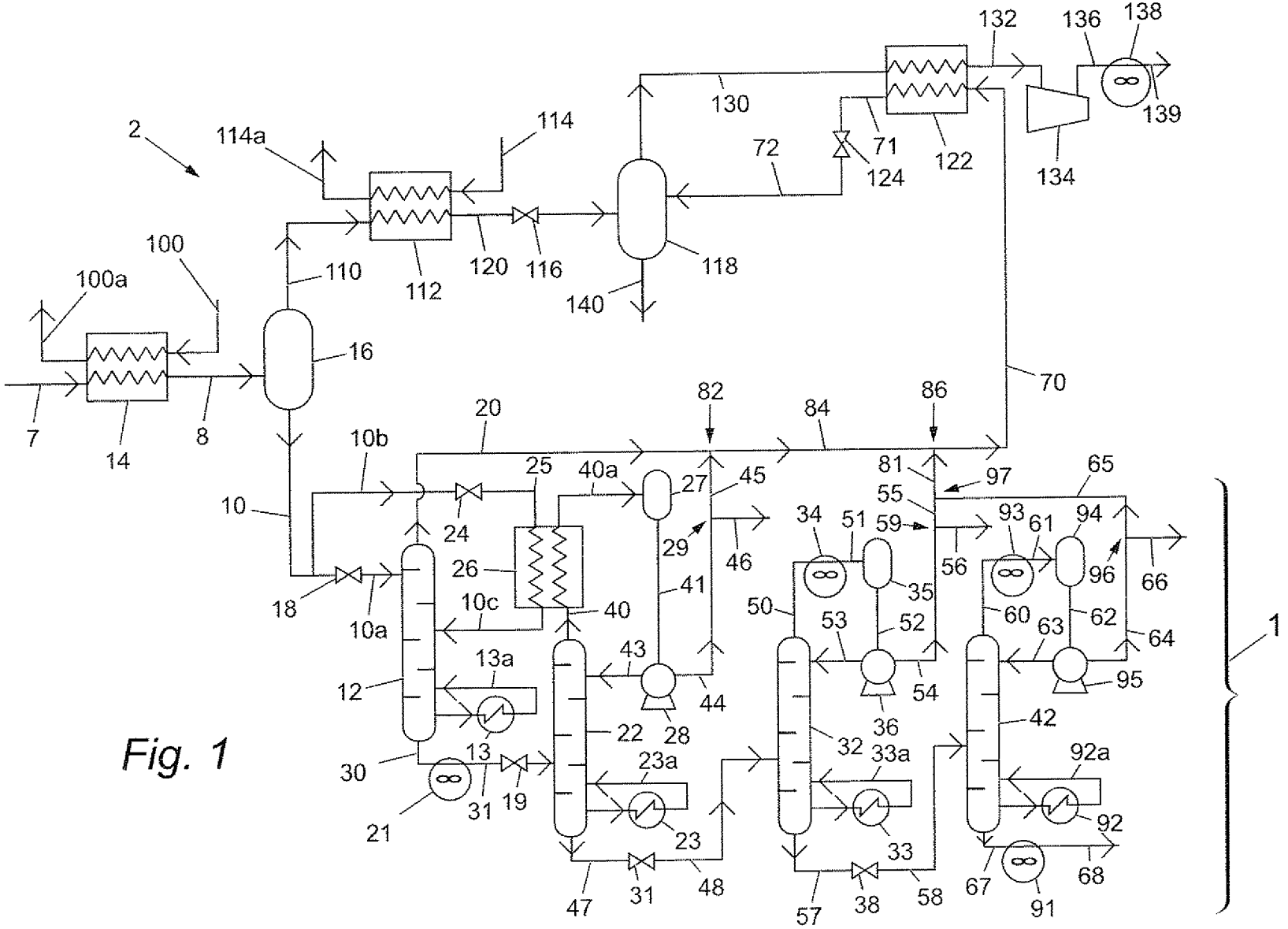
FIG. 1 is a first diagrammatic scheme for a method of cooling according to one embodiment of the present invention.

For the purpose of this description, a single reference number will be assigned to a line as well as a stream carried in that line.

DETAILED DESCRIPTION OF THE PREFERRED EMBODIMENTS

The present disclosure shows cooling of one or more streams separated from a related mixed hydrocarbon feed stream as part of a multi-column natural gas liquids (NGL) recovery system and arrangement.

Embodiments described herein provide a highly efficient configuration for the production of an at least partly, preferably fully, liquefied cooled stream from one or more streams separated from an NGL recovery system.

Disclosed are various methods and apparatus. These methods comprise at least the steps of:

(a) passing an initial hydrocarbon stream through a first separator to provide an initial overhead stream and a mixed hydrocarbon feed stream;

(b) cooling, preferably liquefying, the initial overhead stream to provide a cooled, preferably liquefied, hydrocarbon stream;

(c) separating at least a C1 overhead stream and one or more C2, C3 and C4 overhead streams from the mixed hydrocarbon feed stream;

(d) cooling at least a fraction of at least one of the group comprising: the C2 overhead stream, the C3 overhead stream and the C4 overhead stream; with the C1 overhead stream, to provide a cooled stream; and (e) further cooling the cooled stream against at least a fraction of the cooled, preferably liquefied, hydrocarbon stream to provide an at least partly liquefied cooled stream.

The apparatus comprise at least:

a first separator through which an initial hydrocarbon stream passes to provide an initial overhead stream and a mixed hydrocarbon feed stream;

a cooling system to cool, preferably liquefy, the initial overhead stream to provide a cooled, preferably liquefied, hydrocarbon stream such as LNG;

an NGL recovery system to separate at least a C1 overhead stream and one or more C2, C3 and C4 overhead streams from the mixed hydrocarbon feed stream;

means to cool at least a fraction of at least one of the group comprising: the C2 overhead stream, the C3 overhead stream and the C4 overhead stream; with the C1 overhead stream, to provide a cooled stream; and one or more heat exchangers for further cooling the cooled stream against at least a fraction of the cooled, preferably liquefied, hydrocarbon stream to provide an at least partly liquefied cooled stream.

In one group of embodiments, the cooling of the at least the fraction of at least one of the group comprising: the C2 overhead stream, the C3 overhead stream and the C4 overhead stream; with the C1 overhead stream, is achieved by admixing. To this end, the apparatus could comprise a combiner to admix the at least the fraction with the C1 overhead stream.

In this group of embodiments, it is advantageous to further cool the cooled (and admixed) stream at substantially the same pressure as the pressure of the C1 overhead stream as it was separated from the mixed hydrocarbon feed stream. As used herein, the term "substantially the same" means that the difference between the pressure of the C1 overhead stream, provided at the first pressure, and the at least partly liquefied cooled stream, provided at the second pressure, is less than a de minimis, indeliberate, pressure loss resulting from the flow through piping and heat exchanger(s).

By not deliberately lowering the pressure, liquefaction efficiency during the further cooling is not sacrificed. Increasing the pressure would theoretically take the further cooling to a more favourable portion in the phase diagram, but it would adversely require additional capital expenditure and plot space. Thus the proposed group of embodiments takes as much as possible advantage of the pressure that was already available in the C1 overhead stream. And advantageously, no expansion or compression devices need to be provided between the C1 overhead stream and the at least partly liquefied cooled stream.

In another group of embodiments, the cooling of the at least the fraction of at least one of the group comprising: the C2 overhead stream, the C3 overhead stream and the C4 overhead stream; is achieved by indirect heat exchange with the C1 overhead stream. Since admixing is avoided, this allows for a dedicated use of the relatively pure C1 overhead stream. No substantial pressure reduction or increase needs be imposed before the indirect heat exchanging.

In either case, the present invention may be applied to provide first cooling of a stream from NGL recovery by a C1 overhead stream, and subsequent further cooling, preferably fully liquefying, by a fraction of the main cooled, preferably liquefied, hydrocarbon stream, such as end-flash gas. This avoids taking away cooling duty in step (b) of the method of the present invention, which would diminish cooling of the main hydrocarbon stream. Thus, cold energy for the cooling of the main hydrocarbon stream (by a separate refrigerant, refrigeration system and/or circuit) need not be diverted to be involved in NGL recovery, increasing the efficiency of other processes or sections of a liquefaction plant such as an LNG plant.

Embodiments of the present invention provide flexibility for using the cooling of a C1 overhead stream from the NGL recovery to cool at least a fraction of any one of, or any combination of, C2, C3 and C4 overhead streams.

The need for an extra bundle of cooling pipes in a main heat exchanger to accommodate an NGL recovery stream may herewith be avoided, thereby avoiding the additional CAPEX and OPEX required in EP 1 469 266 A1 for its integrated main heat exchanger.

The initial hydrocarbon stream may be any suitable hydrocarbon stream such as, but not limited to, a hydrocarbon-containing gas stream able to be cooled. One example is a natural gas stream obtained from a natural gas or petroleum reservoir. As an alternative the natural gas stream may also be obtained from another source, also including a synthetic source such as a Fischer-Tropsch process.

Usually such an initial hydrocarbon stream is comprised substantially of methane. Preferably such an initial feed stream comprises at least 60 mol % methane, more preferably at least 80 mol % methane.

Although the method according to the present invention is applicable to various hydrocarbon streams, it is particularly suitable for natural gas streams to be liquefied. As the person skilled readily understands how to liquefy a hydrocarbon stream, this is not discussed herein detail.

The C1, C2, C3 and C4 overhead streams may be provided by any known NGL recovery system. An NGL recovery system usually involves one or more distillation columns. The first, and any of second, third or fourth distillation columns useable in the present invention, may be any form of separator adapted to provide at least one overhead stream, usually a gaseous overhead stream, and usually being enriched in one or more lighter hydrocarbons, and at least one bottom stream, usually a liquid stream, and usually being enriched in one or more heavier hydrocarbons. In certain circumstances, an overhead stream and/or a bottom stream may be a mixed phase stream.

An example of a suitable first distillation column is a "demethanizer" designed to provide a methane-enriched overhead stream, and one or more liquid streams at or near the bottom enriched in C2+ hydrocarbons. Similarly, a second distillation column may be a "deethanizer", a third distillation column may be a "depropanizer", and a fourth distillation column may be a "debutanizer". Such columns are known in the art.

Thus, where the first distillation column is a demethanizer, the first bottom stream of the present invention can hereinafter be defined as a C2+ hydrocarbon stream. Where the second distillation column is a deethanizer, the second bottom liquid stream may be defined as a C3+ hydrocarbon stream, and the second overhead gaseous stream is preferably >60 mol % ethane, more preferably >85 mol % and even more preferably >90 mol % ethane.

Each distillation column of the present invention may involve one or more columns, and one or each of such columns could provide individual liquid streams of certain heavier hydrocarbons such as ethane, propane, etc. Commonly, NGL recovery results in a C5+ hydrocarbon stream.

The term "mixed hydrocarbon feed stream" as used herein relates to a feed stream comprising methane (C1) and at least 5 mol % of one or more hydrocarbons selected from the group comprising: ethane (C2), propane (C3), butanes (C4), and C5+ hydrocarbons.

The term "C5+ hydrocarbon stream" relates to a stream comprising "pentanes" and heavier hydrocarbons, often also termed 'light condensates'.

The terms "C2+", "C3+" et al relate to a stream comprising ethane and heavier hydrocarbons, propane and heavier hydrocarbons, et al.

Any C2, C3, and C4 stream may still comprise a minor (<10 mol %) amount of methane; each such stream is preferably >80 mol %, more preferably >95 mol %, of its main component, ethane, propane and the butanes, respectively.

The division of a stream such as a feed stream or an overhead stream into two or more part streams may be carried out using any suitable stream splitter or divider, which may be a distinct unit, or a simpler division of a line such as a T-piece.

FIG. 1 shows a simplified and first general scheme of a liquefied natural gas plant 2 for a method for cooling an initial hydrocarbon stream 8 which separated into a mixed hydrocarbon feed stream 10 and a methane-enriched stream 110, which methane-enriched stream 110 is subsequently cooled, preferably liquefied, to provide a cooled, preferably liquefied, hydrocarbon stream 120, preferably LNG. Meanwhile, FIG. 1 also shows an NGL recovery system 1 wherein the mixed hydrocarbon feed stream 10 is separated into a C1 stream (20) and one or more C2, C3 and C4 streams (40, 50, 60, respectively).

The initial feed stream 7 may contain natural gas. It is cooled by a pre-cooling heat exchanger 14 to provide a cooled and partly condensed initial hydrocarbon stream 8. The pre-cooling heat exchanger 14 may comprise one or more heat exchangers either in parallel, series or both, in a manner known in the art. Cooling in the pre-cooling heat exchanger 14 is provided by a first refrigerant stream 100, which is warmed in the pre-cooling heat exchanger 14 to provide a warmed first refrigerant stream 100*a*.

The cooling of the initial feed stream 7 may be part of a liquefaction process, such as a pre-cooling stage involving a propane refrigerant circuit as described hereinafter in relation to FIG. 2, or a separate process.

Cooling of the initial feed stream 7 may involve reducing the temperature of the initial feed stream 7 to below −0° C., for example, in the range −10° C. to −70° C.

The cooled initial hydrocarbon stream 8 is passed into a first separator 16 such as a scrub column 16, operating at an above ambient pressure in a manner known in the art. The scrub column 16 provides a condensed mixed hydrocarbon feed stream 10, preferably having a temperature below −0° C., and an initial overhead steam, in the present specification also referred to as the methane-enriched stream 110. The initial gaseous overhead stream 110 is usually greater than 80 mol % methane, and is an enriched-methane stream compared to the cooled initial hydrocarbon stream 8.

The mixed hydrocarbon feed stream 10 comprises methane and one or more of C2, C3, C4 and C5+ hydrocarbons. Typically, the proportion of methane in the mixed hydrocarbon feed stream 10 is 30-50 mol %, with a significant fraction of ethane and propane, such as 5-10 mol % each.

In NGL recovery, it is desired to recover any methane in a mixed hydrocarbon stream (for use as a fuel or to be liquefied in the LNG plant 2 and provided as additional LNG), and to provide one or more of a C2 stream, a C3 stream, a C4 stream, and a C5+ stream.

In FIG. 1, at least a fraction, usually all, of the mixed hydrocarbon feed stream 10 passes into the NGL recovery system 1, through a valve 18 to provide a reduced pressure mixed hydrocarbon feed stream 10*a*, and then enters a first distillation column 12 at or near the top thereof. The reduced pressure mixed hydrocarbon feed stream 10*a* is typically a mixed phased stream, and the first distillation column 12 is adapted to separate the gaseous and vapour phases, so as to provide a C1 overhead stream 20 and a first bottom stream 30.

The nature of the streams provided by the first distillation column 12 can be varied according to the size and type of distillation column, and its operating conditions and parameters, in a manner known in the art. For the arrangement shown in FIG. 1, it is desired for the C1 overhead stream 20 to be methane-enriched, preferably to be >90 mol % methane.

The first distillation column 12 also includes a first reboiler 13 and a first reboiler vapour return stream 13*a* in a manner known in the art.

The first bottom stream 30 is predominantly a C2+ hydrocarbon stream, such as >90 or >95 mol % ethane and heavier hydrocarbons. The first bottom stream 30 is cooled by one or more ambient coolers, such as a water and/or air cooler 21, to provide a cooled first bottom stream 31, followed by a passage through a valve 19 and entry into a second distillation column 22. Again, the type, size and capacity of the second distillation column 22, as well as its operating conditions and parameters, will control the nature of the streams provided by the second distillation column 22.

In the arrangement shown in FIG. 1, the second distillation column 22 provides a C2 overhead stream 40 being predominantly ethane, preferably >85 mol % or >90 mol % ethane, and a second bottom stream 47, generally being a C3+ stream comprising >98 mol % propane and heavier hydrocarbons. The second distillation column 22 also includes a second reboiler 23 and a second reboiler vapour return stream 23*a*.

Optionally, a fraction of the mixed hydrocarbon feed stream 10 is provided as a side stream 10*b*. The side stream 10*b* can pass through a valve 24 to provide a reduced pressure stream 25, which has a temperature that is low enough, such as between 0° C. and −50° C., to provide cooling in a first heat exchanger 26 to the C2 overhead stream 40. The first heat exchanger 26 may be one or more heat exchangers in parallel, series or both.

The cold energy of the reduced pressure stream 25 withdraws warmth from the C2 overhead stream 40 to at least partially condense, preferably fully condense, the C2 overhead stream 40 in the heat exchanger 26, and provide an at least partly condensed C2 stream 40*a*.

The at least partly condensed C2 stream 40*a* can be divided by a separator 27 to provide a separator bottom stream 41, which could pass into a pump 28 and be divided into a C2 reflux stream 43 for return to the second distillation column 22, and a C2 product stream 44. The C2 product stream 44 itself can then be divided by a divider 29 into a first C2 fraction 46 for use outside a liquefaction plant, or as a refrigerant or as a component of a refrigerant in a liquefaction plant, such as in a mixed refrigerant known in the art, and a second C2 fraction 45 for use with the present invention as discussed hereinafter.

The percentage ratio of the division of the separator bottom stream 41 and/or the C2 product stream 44 as discussed above may be any suitable ratio between 0-100%. Factors influencing the ratio include the operating conditions and parameters of the second distillation column 22, the external or internal requirement for C2 for use as a refrigerant, or to replenish or supplement a refrigerant, etc.

The heat exchange of the C2 overhead stream 40 and the reduced pressure stream 25 also provides a warmer reduced pressure stream 10*c*, which can be passed into the first distillation column 12.

The second bottom stream 47 is predominately a C3+ hydrocarbon stream, such as >90 or >95 mol % of propane and heavier hydrocarbons. The second bottom stream 47 passes through a valve 31 to provide a reduced pressure second bottom stream 48, which passes into a third distillation column 32. The type, size and capacity of the third distillation column 32, as well as its operating conditions and parameters, will control the nature of the streams provided by the third distillation column 32.

In the arrangement shown in FIG. 1, the third distillation column 32 provides a C3 overhead stream 50 being predominately propane, preferably being >85 mol % or >90 mol % propane, and a third bottom stream 57, generally being a C4+ stream comprising >90 mol % butanes and heavier hydrocarbon. The third distillation column 32 also includes a third reboiler 33 and third reboiler vapour return stream 33*a*.

The C3 overhead stream 50 passes through one or more ambient coolers, such as a water and/or air cooler 34, to provide a cooled C3 overhead stream 51, which is divided by a separator 35 to provide a separator bottom stream 52 which passes into a pump 36 and is divided into a C3 reflux stream 53 for return to the third distillation column 32, and a C3 product stream 54. The C3 product stream 54 itself can then be divided by a divider 59 into a first C3 fraction 56 for use outside a liquefaction plant, or as a refrigerant or as a component of a refrigerant in a liquefaction plant, such as in a mixed refrigerant known in the art, and a second C3 fraction 55 for use with the present invention as discussed hereinafter.

The percentage ratio of the division of the separator bottom stream 52 and/or the C3 product stream 54 as discussed above may be any suitable ratio between 0-100%. Factors influencing the ratio include the operating conditions and parameters of the second distillation column 32, the external or internal requirement for C3 for use as a refrigerant, or to replenish or supplement a refrigerant, etc.

The third bottom stream 57 passes through a valve 38 to provide a reduced pressure third bottom stream 58, which passes into a fourth distillation column 42. The type, size and capacity of the fourth distillation column 42, as well as its operating conditions and parameters, will control the nature of the streams provided by the fourth distillation column 42.

In the arrangement shown in FIG. 1, the fourth distillation column 42 provides a C4 overhead stream 60 being predominately butane and/or i-butane, preferably >85 or >90 mol % butane(s), and a C5+ bottom stream 67. The C5 bottom stream 67 may pass through one or more ambient coolers such as a water and/or air cooler 91 to provide a C5+ product stream 68 in a manner known in the art. The fourth distillation column 42 also includes a fourth reboiler 92 and a fourth reboiler vapour return stream 92*a*.

The C4 overhead stream 60 may pass through one or more ambient coolers such as a water and/or air cooler 93 to provide a cooled C4 overhead stream 61, which passes into a separator 94 to provide a separator bottom stream 62, which could pass into a pump 95 and be divided into a C4 reflux stream 63 for return to the fourth distillation column 42, and C4 a product stream 64. The C4 product stream 64 itself can then be divided by a divider 96 into a first C4 fraction 66 for use outside a liquefaction plant, or as a refrigerant or as a component of a refrigerant in a liquefaction plant, such as in a mixed refrigerant known in the art, and a second C4 fraction 65 for use with the present invention.

The percentage ratio of the division of the separator bottom stream 62 and/or the C4 product stream 64 as discussed above may be any suitable ratio between 0-100%. Factors influencing the ratio include the operating conditions and parameters of the fourth distillation column 32, the external or internal requirement for C4 for use as a refrigerant, or to replenish or supplement a refrigerant, etc.

In the arrangement shown in FIG. 1, the second C4 fraction 65 is combined by a combiner 97 with the second C3 fraction 55 to provide a combined C3 and C4 product stream 81.

Meanwhile, the C1 overhead stream 20 is combined by a combiner 82 with the second C2 fraction 45 to provide a combined C1 and C2 stream 84, which is then also combined with the combined C3 and C4 stream 81 by a combiner 86 to provide a cooled stream 70.

Typically, C1 overhead stream 20 has a temperature below 0° C., such as in the range −10° C. to −100° C., more usually in the range −30° C. to −70° C.

The second C2 fraction 45 typically has a temperature below 10° C., such as between 10° C. and −20° C., more usually in the range 5° C. to −10° C.

The second C3 fraction 55 and the second C4 fraction 65 typically have a temperature above 0° C., usually in the range 0° C. to 60° C.

Thus, by using the C1 overhead stream 20 with at least a fraction of a least of one of the group comprising; the C2 overhead stream 40, the C3 overhead stream 50 and the C4 overhead stream 60; said at least fraction(s) are cooled by the C1 overhead stream 20 because the C1 overhead stream 20 is the coolest of said streams and fractions. The piping combining the C1 overhead stream 20 with at least said fraction(s) provide the means to cool said fraction (s).

FIG. 1 shows an arrangement where second fractions 45, 55, 65 of each of the C2 overhead stream 40, the C3 overhead stream 50 and the C4 overhead stream 60, are cooled by the C1 overhead stream 20, by being combined therewith, and therefore being in admixture therewith. In this way, the C1 overhead stream 20 provides direct cooling to the second fractions 45, 55, 65. In the arrangement shown in FIG. 1, the combination or admixture of the C1 overhead stream 20, the second C2 fraction 45 and the combined C3 and C4 stream 81 provide a cooled stream 70 as a single stream.

Preferably, the cooled stream 70 has a temperature below 0° C. The cooled stream 70 may be a mixed phase stream, i.e. partly liquid.

FIG. 1 also shows the initial overhead stream 110 from the scrub column 16 passing into a main heat exchanger 112 to provide a further cooled and at least partially condensed, preferably fully condensed or liquefied, hydrocarbon stream 120. Cooling in the main heat exchanger 112 is provided by a second refrigerant stream 114, which is warmed in the main heat exchanger 112 to provide a warmed second refrigerant stream 114*a*. The cooled, preferably liquefied, hydrocarbon stream 120 passes through a valve 116 and into an end gas/liquid separator such as an end-flash vessel 118. The action of an end-flash vessel 118 is known in the art, and it provides an overhead stream, which may be termed end-flash gas 130, and a liquefied product stream 140, which is preferably LNG.

In the arrangement shown in FIG. 1, the cooled stream 70 can then be further cooled, preferably sub-cooled, by passing it through a second heat exchanger 122. This provides an at least partly liquefied cooled (or sub-cooled) stream 71, which, after passing through a valve 124, provides a reduced-pressure cooled stream 72, which then passes into the end-flash vessel 118. Hence, the at least partly liquefied cooled stream 71 is combined with the cooled hydrocarbon stream 120, either upstream of the end flash vessel 118 (e.g. using any type of junction or combiner known in the art) or directly in the end-flash vessel 118 as shown in FIG. 1.

Cooling for the second heat exchanger 122 can be provided by the end-flash gas 130, and the warmed end-flash gas stream 132 thereafter can be compressed by a end-compressor 134 to provide a compressed end-stream 136, which can be cooled one or more ambient coolers 138 to provide a fuel stream 139 for use in a manner known in the art.

Preferably, the pressure of the reduced-pressure cooled stream 72 is the same or similar to the pressure of the expanded cooled hydrocarbon stream after the valve 116, such that they can be readily and easily combined, such as in the end-flash vessel 118.

Also preferably, the at least partly liquefied cooled stream 71 is within 40° C., preferably within 10° C., of the cooled, preferably liquefied, hydrocarbon stream 120.

It is another advantage of the present invention that no external refrigeration is required for the combination of the at least partially liquefied cooled stream 71 with the cooled hydrocarbon stream 120. Thus, the present invention can achieve re-injection of at least fractions of the overhead streams from one or more of the distillation columns 12, 22, 32, 42 into the end step or stage of a liquefaction process, such as the end-flash vessel 118 shown in FIG. 1.

An advantage of sub-cooling the cooled stream 70 is that less flash vapour will form during the pressure reduction while passing through valve 124, and hence a larger fraction of the cooled stream 70 will end up in the liquid product stream 140 from the end-flash vessel 118.

The C1 overhead stream 20 is particularly useful in being able to cool at least a fraction of at least one of the group comprising: the C2 overhead stream 40, the C3 overhead stream 50 and the C4 overhead stream 60; which would otherwise be too warm for liquefaction and combining with the cooled hydrocarbon stream 120.

It is apparent from the foregoing that there is no need to recompress or decompress the C1 overhead stream 20 or a stream combined with it until after the generation of the at least partly liquefied cooled stream 71. Thus, the pressure of the at least partly liquefied cooled stream 71 is substantially the same as the C1 overhead stream, with none of the intervening steps resulting in a substantial increase in pressure.

The present invention does not require any recompression of the C1 overhead stream 20, generated from the mixed hydrocarbon feed stream 10 prior to the cooling of the at least the fraction of the at least one of the C2, C3 or C4 overhead streams 45, 55, 65 with the C1 overhead stream 20 to provide a cooled stream 70. Similarly, no recompression of the cooled stream 70 is required before further cooling in the heat exchanger 122 to provide the at least partly liquefied cooled stream 71. Thus, the method and apparatus according to this group of embodiments is advantageous because there is no need to recompress the C1 overhead stream 20 or a stream containing it, up until after the at least partly liquefied cooled stream 71 is expanded to provide reduced-pressure cooled stream 72 and passed to the end flash vessel 118. In this way, the point at which the reduced-pressure cooled stream 72 is combined with the cooled hydrocarbon stream 120 is chosen such that no pressurisation of the reduced-pressure cooled stream 72 is required.

This provides significant CAPEX savings because there is no requirement for a compressor in the NGL recovery system 1 and OPEX savings in terms of the operation power saved by dispensing with such recompression.

There is also no need to expand the C1 overhead stream 20 or a stream containing it until after the generation of the at least partly liquefied cooled hydrocarbon stream 71. The cooled stream 70 which can be at a sixth pressure, can thus be further cooled against at least a fraction of the cooled hydrocarbon stream 120, at substantially the same pressure as the C1 overhead stream 20. This further cooling step provides an at least partly liquefied cooled stream 71. Lower pressure streams will liquefy at a lower temperature, such that by avoiding the need to decompress these streams, the at least partial liquefaction in heat exchanger 122 is improved, compared to a system in which one or more of these streams are expanded prior to the at least partial liquefaction step.

For instance, cooled stream 70 as described herein can be at a pressure of approximated 35 bar, substantially the same pressure as the C1 overhead stream from which it is derived. The cooling of such a non-depressurised cooled stream 70 in second heat exchanger 122 against the end-flash gas 130, to provide the at least part liquefied stream 71, subsequent expansion in valve 124 to approximately ambient pressure as reduced-pressure cooled stream 72 and then flashing in end-flash vessel 118 can provide 22% more liquefied hydrocarbon from the reduced-pressure cooled stream 72 compared to a cooled stream 70 which has been let down to a pressure of approximately 10 bar using an expansion device prior to cooling in the second heat exchanger 122, expanding to about ambient pressure and then carrying out an end flash step as described herein. The comparison is based on an equal flow rate of stream 70 and an equal size heat exchanger 122.

Figure 2:
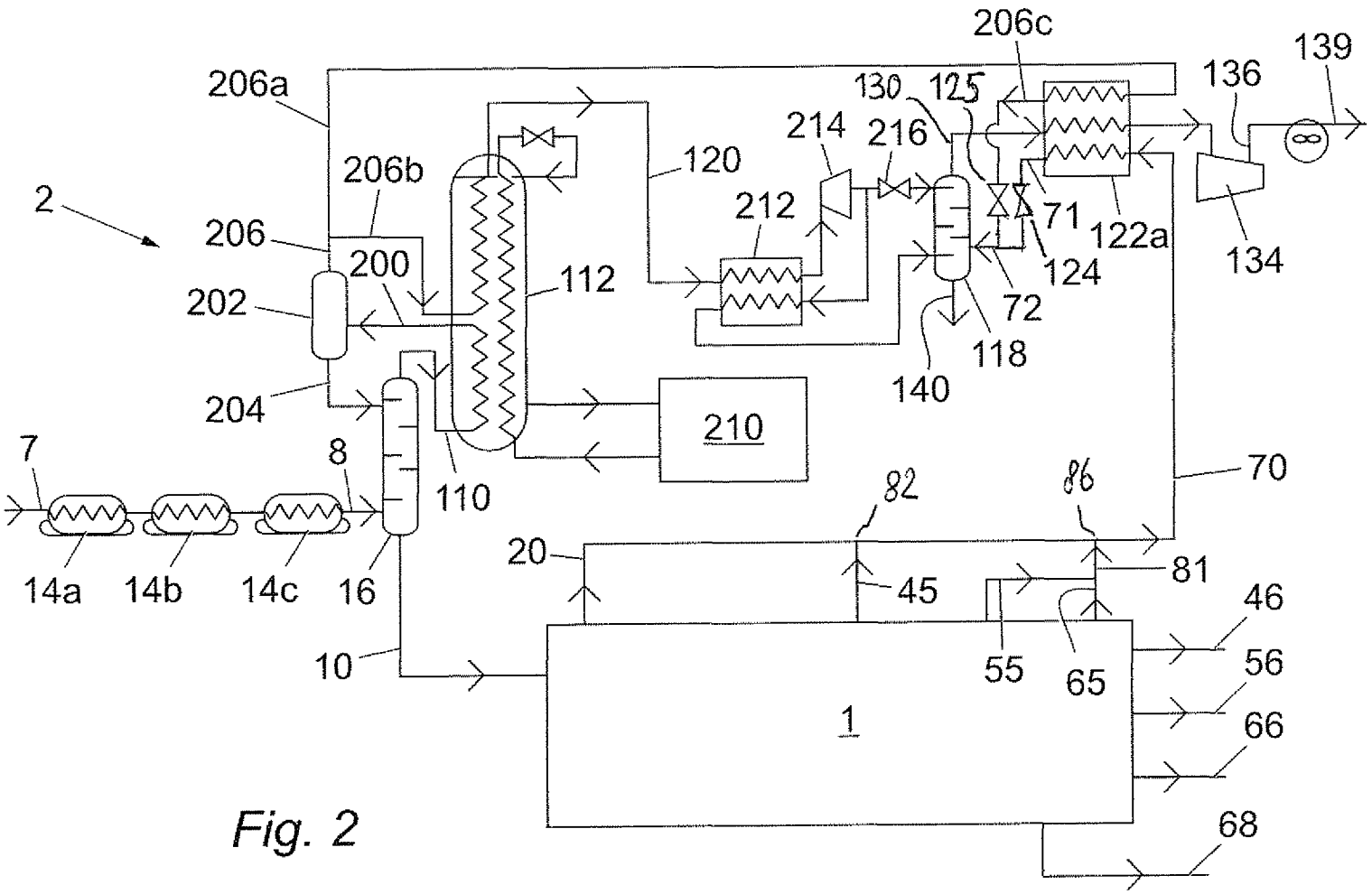
FIG. 2 shows a third diagrammatic scheme for a method of cooling according to another embodiment.

FIG. 2 is a more detailed scheme of the method and arrangement shown in FIG. 1. FIG. 2 shows the LNG plant 2 incorporating the NGL recovery system 1 shown in FIG. 1.

FIG. 2 shows an initial feed stream 7 being cooled by three pre-cooling heat exchangers 14*a*, 14*b* and 14*c* (equivalent to the pre-cooling heat exchanger 14 shown in FIG. 1) to provide the cooled initial hydrocarbon stream 8 which passes into the scrub column 16. The scrub column 16 provides the condensed mixed hydrocarbon feed stream 10, which passes into the NGL recovery system 1 described above, to provide a cooled stream 70 and first C2, C3, C4 fractions 46, 56, 66, and a C5+ product stream 68.

The scrub column 16 also provides an initial overhead stream 110 which passes into the main heat exchanger 112, is part-cooled thereby, and provides a side stream 200 which passes into a separator 202 which provides a bottom reflux stream 204 for return into the scrub column 16, and an overhead stream 206. A first fraction, usually <5 vol %, of the overhead stream 206 can be provided as a side stream 206*a*, whilst the majority of the overhead stream 206 is passed as a second fraction stream 206*b* back into the main heat exchanger 112 for liquefaction to provide a cooled, preferably liquefied stream 120.

FIG. 2 also shows a main refrigerant circuit 210 for providing the cooling to the main heat exchanger 112. Refrigerant circuits are known in the art, and typically comprise one or more refrigerant compressors, ambient coolers, refrigerant coolers, and division of the refrigerant stream into light and heavy refrigerant fractions which can be separately used in the main heat exchanger 112 in a manner known in the art.

The cooled hydrocarbon stream 120 passes through a third heat exchanger 212, an expander 214, and a valve 216, for entry into the end-flash vessel 118. From the end-flash vessel 118, the end-flash gas 130 passes through the second heat exchanger 122 to provide cooling to the cooled stream 70, prior to its compression and cooling to provide a fuel stream 139.

FIG. 2 also shows cooling of the side stream 206*a* in the second heat exchanger 122 by the end-flash gas 130, which cooled side stream 206*c* can then be let down in pressure via valve 125, and subsequently combined with the at least partly liquefied cooled stream 71 prior to the valve 124 or downstream of valve 124.

In FIGS. 1 and 2, the C1 overhead stream 20 is part of the cooled stream 70, and the cooled stream 70 is subsequently liquefied against a fraction of the cooled hydrocarbon stream 120, in particular the end-flash gas 130. The at least partly liquefied cooled stream 71 created thereby is subsequently combined with the cooled hydrocarbon stream 120.

In particular, the pressure of the at least partly liquefied cooled stream 71 in the embodiments of FIGS. 1 and 2 is substantially the same as the pressure of the C1 overhead stream 20. Thus, the pressure of the cooled stream 70, which is intermediary between the C1 overhead stream 20 and the at least partly liquefied cooled stream 71, is also at substantially the same pressure as these other streams. This means that no compression or expansion steps are necessary between the C1 overhead stream 20 and the at least partly liquefied cooled stream 71.

As used herein, the term "substantially the same" means that the difference between the pressure of the C1 overhead stream 20, provided at a first pressure, and the at least partly liquefied cooled stream 71, provided at a second pressure is less than a de minimus pressure loss resulting from flow through piping and heat exchanger(s), which may be less than 10 bar, more preferably less than 5 bar, even more preferably less than 1 bar.

By producing the at least partly liquefied cooled stream 71 at substantially the same pressure as the C1 overhead stream 20, on the one hand, no compression of the C1 overhead stream 20, or the cooled stream 84,70 which is formed from it, is required. Thus, there need not to be any compressors between the C1 overhead stream 20 and the at least partly liquefied cooled stream 71. This line-up provides significant CAPEX savings because compressors in the NGL recovery system and for the cooled stream are rendered unnecessary. OPEX savings are also provided in terms of the operation power saved by dispensing with the need to drive compressors to compress one or more of these streams.

In addition, on the other hand, there is no requirement to reduce the pressure of the C1, C2, C3 and C4 overhead streams and the cooled stream 70 in the present configuration either. Thus, there do not need to be any expansion devices between the C1 overhead stream 20 and the at least partly liquefied cooled stream 71. By avoiding the need for such a reduction in pressure of the streams, the cooled stream is further cooled against at least a fraction of the cooled hydrocarbon stream at a higher pressure compared to other systems in which one or more pressure reductions are carried out. At such higher pressures, the latent heat required to provide the at least partly liquefied cooled stream is believed to be lower, leading to a more efficient further cooling operation. Thus, the first pressure at which the C1 overhead stream is provided is also a beneficial pressure for the further cooling of the cooled stream.

Figure 3:
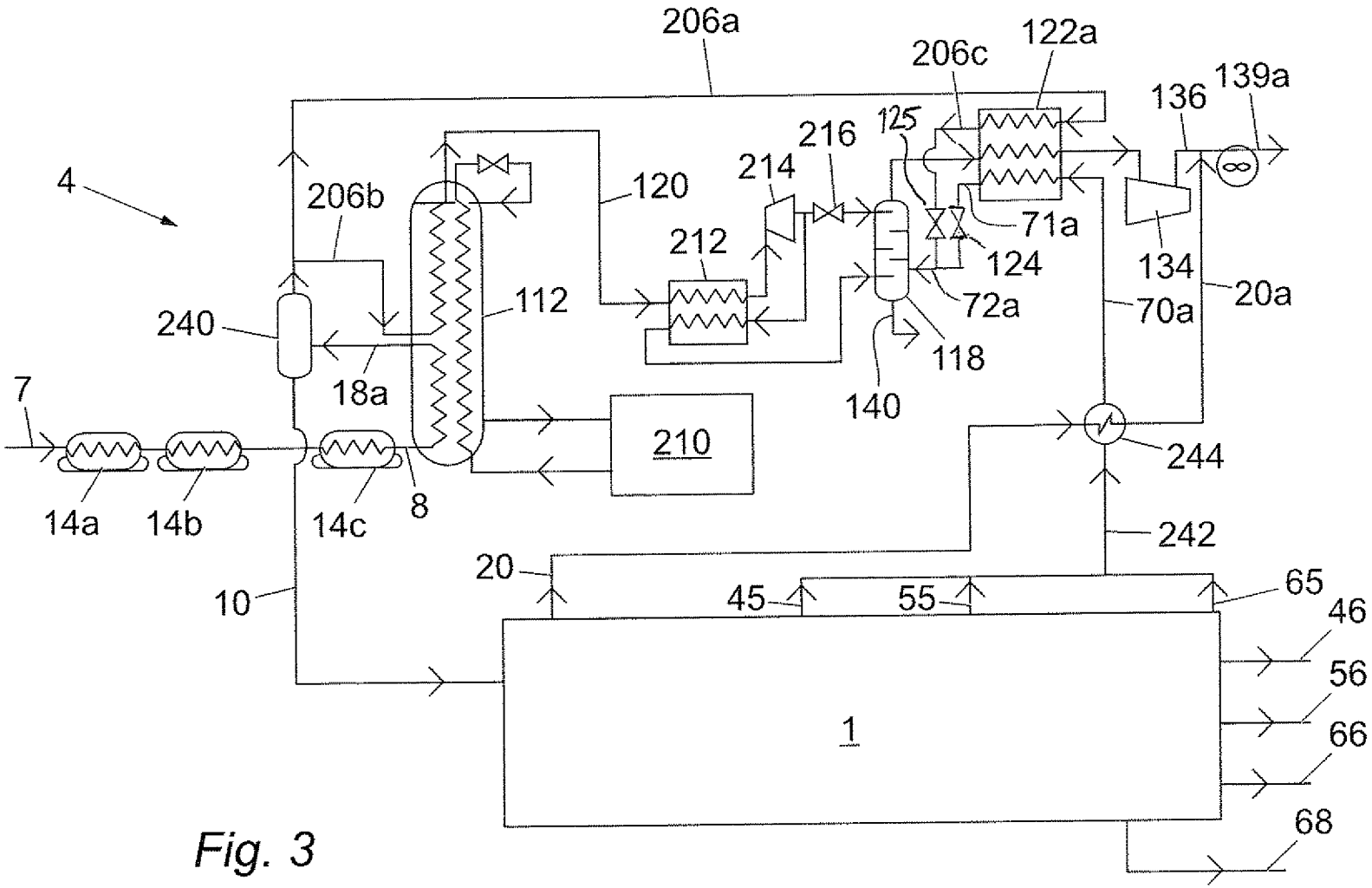
FIG. 3 is a second diagrammatic scheme for a method of cooling according to a second group of embodiments.

FIG. 3 shows an alternative scheme 4 according to another embodiment of the present invention. Here, the cooling of the at least the fraction of the at least one of the group defined in step (d)—the group comprising the C2 overhead stream, the C3 overhead stream, and the C4 overhead stream—is effected by indirect heat exchange with the C1 overhead stream 20, which does not require admixing with the C1 overhead stream 20. After having been warmed by the indirect heat exchange, the C1 overhead stream 20*a* may be used, for instance, as fuel gas.

In the arrangement shown in FIG. 3, the initial feed stream 7 containing natural gas is cooled by three pre-cooling heat exchangers 14*a*, 14*b*, 14*c* to provide a cooled and partially condensed initial hydrocarbon stream 8, which passes directly into the main heat exchanger 112 to provide a further cooled initial hydrocarbon stream 18*a*.

The further cooled hydrocarbon stream 18*a* passes into a separator 240 to provide, as a bottom stream, a mixed hydrocarbon feed stream 10 which can then pass into an NGL recovery system 1 as described above to provide a C1 overhead stream 20, a second C2 fraction 45, a second C3 fraction 55 and a second C4 fraction 65 as herein before described.

The second C2, C3 and C4 fractions 45, 55, 65 are combined to form a combined stream 242 which passes into a fourth heat exchanger 244. Also passing into the fourth heat exchanger 244 is the C1 overhead stream 20, which, being cooler, provides cooling to the combined stream 242 to provide a warmed C1 overhead stream 20*a*, and a cooled stream 70*a*. The fourth heat exchanger 244 is one means to cool said fraction(s).

The warmed C1 overhead stream 20*a* can be combined with one or more other methane-predominant streams, such as a compressed end-flash gas stream 136, for use as a fuel stream 139*a*.

Meanwhile, the cooled stream 70*a* passes through a heat exchanger 122*a* to provide an at least partly liquefied cooled stream 71*a*, which can be passed through a valve 124, and optionally combined with a liquefied side stream 206*c* as described hereinbefore, to provide a reduced pressure combined stream 72*a* which can then pass into an end-flash vessel 118.

The main overhead fraction 206*b* from the separator 240 is at least partially, preferably fully, condensed in the main heat exchanger 112 to provide a cooled, preferably liquefied, hydrocarbon stream 120. The cooled hydrocarbon stream 120 passes through a third heat exchanger 212, expander 214 and a valve 216, to provide an end-feed stream 222 which passes into an end-flash vessel 118.

Table 1 below gives an overview of estimated compositions, phases, pressures and temperatures of some of the streams at various parts of an example process of the arrangement shown in FIG. 2.

TABLE 1

| Stream | Phase | Temp ° C. | Pressure Bar | Mass Rate kg/s | N2 | C1 | C2 | C3 mol % | iC4 | C4 | C5+ |
|---|---|---|---|---|---|---|---|---|---|---|---|
| 10 | V/L | −50.8 | 62.0 | 11.0 | 0.53 | 59.91 | 11.49 | 8.27 | 2.69 | 4.44 | 12.65 |
| 10a | V/L | −66.2 | 35.0 | 6.6 | 0.53 | 59.91 | 11.49 | 8.27 | 2.69 | 4.44 | 12.65 |
| 10b | V/L | −50.8 | 62.0 | 4.4 | 0.53 | 59.91 | 11.49 | 8.27 | 2.69 | 4.44 | 12.65 |
| 10c | V/L | 2.6 | 39.5 | 4.4 | 0.53 | 59.91 | 11.49 | 8.27 | 2.69 | 4.44 | 12.65 |
| 20 | V | −65.4 | 35.0 | 3.5 | 0.86 | 96.06 | 2.66 | 0.34 | 0.03 | 0.03 | 0.00 |
| 30 | V/L | 93.8 | 35.1 | 7.5 | 0.00 | 1.00 | 25.88 | 21.20 | 7.03 | 11.62 | 33.26 |
| 31 | L | 43.0 | 34.6 | 7.5 | 0.00 | 1.00 | 25.88 | 21.20 | 7.03 | 11.62 | 33.26 |
| 40 | V | 9.9 | 27.4 | 3.1 | 0.00 | 3.54 | 91.46 | 4.95 | 0.00 | 0.00 | 0.00 |
| 45 | L | 3.3 | 40.0 | 1.1 | 0.00 | 3.54 | 91.46 | 4.95 | 0.00 | 0.00 | 0.00 |
| 47 | L | 141.4 | 27.7 | 6.4 | 0.00 | 0.00 | 0.08 | 27.59 | 9.79 | 16.20 | 46.34 |
| 48 | V/L | 119.1 | 15.5 | 6.4 | 0.00 | 0.00 | 0.08 | 27.59 | 9.79 | 16.20 | 46.34 |
| 55 | L | 46.9 | 40.0 | 1.1 | 0.00 | 0.00 | 0.29 | 99.41 | 0.29 | 0.01 | 0.00 |
| 65 | L | 50.1 | 40.0 | 1.2 | 0.00 | 0.00 | 0.00 | 1.02 | 45.04 | 53.93 | 0.00 |
| 70 | V/L | −27.4 | 35.0 | 6.9 | 0.62 | 69.61 | 13.35 | 9.61 | 3.10 | 3.68 | 0.00 |

V = vapour,
L = liquid

The person skilled in the art will understand that the present invention can be carried out in many various ways without departing from the scope of the appended claims.

The invention claimed is:

1. A method, comprising at least the steps of:

(a) passing an initial hydrocarbon stream through a first separator to provide an initial overhead stream and a mixed hydrocarbon feed stream;

(b) cooling the initial overhead stream in a main heat exchanger to provide a cooled hydrocarbon stream;

(c) separating a C1 overhead stream from the mixed hydrocarbon feed stream, and subsequently separating one or more C2, C3 and C4 overhead streams from the mixed hydrocarbon feed stream;

(d) admixing one or more of the C2 overhead stream, the C3 overhead stream and the C4 overhead stream with the C1 overhead stream to provide a cooled stream, thereby bypassing the main heat exchanger;

(e) passing the cooled hydrocarbon stream through a first valve to provide an expanded cooled hydrocarbon stream and passing the expanded cooled hydrocarbon stream into an end gas/liquid separator to provide:
an end-flash gas stream, and
a liquefied product stream;

(f) passing the cooled stream to a second heat exchanger, thereby still bypassing the main heat exchanger, and further indirectly cooling the cooled stream against the end-flash gas stream in the second heat exchanger to provide an at least partly liquefied cooled stream, and subsequently (g) combining the at least partly liquefied cooled stream with the expanded cooled hydrocarbon stream.

2. The method according to claim 1, wherein the cooling in step (b) comprises liquefying such that the cooled hydrocarbon stream is a liquefied hydrocarbon stream.

3. The method according to claim 1, wherein said further cooling the cooled stream comprises sub-cooling of the cooled stream, such that the at least partly liquefied cooled stream is a sub-cooled liquefied stream.

4. The method according to claim 1, wherein the at least partly liquefied cooled stream is within 40° C. of temperature of the end-flash gas stream of step (e).

5. The method according to claim 1, wherein step (d) comprises at least the steps of:

(i) passing at least a fraction of the mixed hydrocarbon feed stream into a first distillation column to provide the C1 overhead stream and a first bottom stream;

(ii) passing at least a fraction of the first bottom stream into at least one of the group comprising: a second distillation column, a third distillation column and a fourth distillation column; to provide at least one of the group comprising: the C2 overhead stream, the C3 overhead stream and the C4 overhead stream.

6. The method according to claim 5, wherein the second distillation column, the third distillation column, and the fourth distillation column provides the C2 overhead stream, the C3 overhead stream and the C4 overhead stream, respectively.

7. The method as claimed in claim 6, wherein at least a fraction of each of the C2 overhead stream, the C3 overhead stream and the C4 overhead stream is cooled by the C1 overhead stream.

8. The method according to claim 1, wherein the cooled stream has a temperature below 0° C.

9. The method according to claim 1, wherein the initial hydrocarbon stream comprises natural gas and the liquefied product stream is LNG.

10. The method according to claim 1, wherein the at least partly liquefied cooled stream is within 10° C. of the end-flash gas stream.

11. The method according to claim 1, further comprising precooling a hydrocarbon stream to provide a precooled hydrocarbon stream, the precooled hydrocarbon stream being the initial hydrocarbon stream.

12. The method according to claim 1, the step of passing the cooled stream to the second heat exchanger comprising passing the cooled stream directly to the second heat exchanger, the step of combining the at least partly liquefied cooled stream with the expanded cooled hydrocarbon stream comprising:

passing the at least partly liquefied cooled stream through a second valve to provide a reduced-pressure cooled stream, and subsequently combining the reduced-pressure cooled stream with the expanded cooled hydrocarbon stream.

13. The method according to claim 12, the step of combining the reduced-pressure cooled stream with the expanded cooled hydrocarbon stream comprising:

passing the expanded cooled hydrocarbon stream to a first inlet of the end gas/liquid separator; and passing the reduced-pressure cooled stream to a second inlet of the end gas/liquid separator.

14. The method according to claim 1, the step of combining the at least partly liquefied cooled stream with the expanded cooled hydrocarbon stream comprising:

passing the expanded cooled hydrocarbon stream to a first inlet of the end gas/liquid separator; and passing the at least partly liquefied cooled stream to a second inlet of the end gas/liquid separator.

* * * * *